US009650700B2

(12) United States Patent
Kang

(10) Patent No.: US 9,650,700 B2
(45) Date of Patent: May 16, 2017

(54) SWASH PLATE AND METHOD OF MANUFACTURING THE SAME

(75) Inventor: Hee Sam Kang, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 1214 days.

(21) Appl. No.: 13/242,075

(22) Filed: Sep. 23, 2011

(65) Prior Publication Data

US 2012/0230861 A1 Sep. 13, 2012

(30) Foreign Application Priority Data

Mar. 9, 2011 (KR) ..... 10-2011-0020730

(51) Int. Cl.

| | |
|---|---|
| ***C22C 21/10*** | (2006.01) |
| ***B22D 25/02*** | (2006.01) |
| ***C22F 1/053*** | (2006.01) |
| ***C23C 18/50*** | (2006.01) |
| ***C25D 7/10*** | (2006.01) |

(52) U.S. Cl.

CPC ..... *C22C 21/10* (2013.01); *B22D 25/02* (2013.01); *C22F 1/053* (2013.01); *C23C 18/50* (2013.01); *C25D 7/10* (2013.01)

(58) Field of Classification Search

IPC ..... C22C 18/04,21/10; C22F 1/053

See application file for complete search history.

(56) References Cited

U.S. PATENT DOCUMENTS 5,845,560 A 12/1998 Nagata et al.

FOREIGN PATENT DOCUMENTS

| | | | | |
|---|---|---|---|---|
| FR | 1140750 | C1 | * | 3/1957 |
| JP | 7-83163 | A | | 3/1995 |
| JP | 8-311634 | A | | 11/1996 |
| JP | 10-77968 | A | | 3/1998 |
| JP | 2000054047 | A | * | 2/2000 |
| KR | 10-0199362 | B1 | | 3/1999 |
| KR | 1020030074110 | A | | 9/2003 |
| KR | 20040070318 | A | | 8/2004 |
| KR | 10-0589223 | B1 | | 6/2006 |
| KR | 1020080092235 | A | | 10/2008 |
| KR | 1020100102301 | A | | 9/2010 |

* cited by examiner

*Primary Examiner* — Roy King
*Assistant Examiner* — Janelle Morillo
(74) *Attorney, Agent, or Firm* — Morgan, Lewis & Bockius LLP

(57) ABSTRACT

A swash plate includes aluminum (Al) as a main component and 35~45 wt % of zinc (Zn), 1.5~3.5 wt % of copper (Cu), 6~10 wt % of silicon (Si), 0.2~0.5 wt % of magnesium (Mg) and other inevitable impurities. A method of manufacturing the swash plate is also provided.

16 Claims, 2 Drawing Sheets

SWASH PLATE AND METHOD OF MANUFACTURING THE SAME

CROSS-REFERENCE TO RELATED APPLICATIONS

The present application claims priority to Korean Patent Application No. 10-2011-0020730 filed on Mar. 9, 2011, the entire contents of which application is incorporated herein for all purposes by this reference.

BACKGROUND OF INVENTION

Field of Invention

The present invention relates to a swash plate which is composed mainly of aluminum, suitable for use in a fixed or variable compressor, and a method of manufacturing the same.

This invention pertains to an aluminum swash plate adapted for a fixed or variable air conditioning compressor, and is particularly advantageous in terms of price competitiveness and weight reduction effects when used in lieu of conventional swash plates made of expensive copper alloy or cast iron material.

Description of Related Art

Generally, when a swash plate type compressor is used in such systems as an automobile air conditioning system, a gaseous coolant which is discharged in a low pressure state from an evaporator can be compressed into a high pressure state so as to be easily liquefied and can then be discharged into a condenser. The swash plate type compressor is provided with a piston which compresses the coolant in the compression chamber of the compressor while being moved in a reciprocal motion by the rotation of the swash plate. The swash plate which rotates in a state of being inclined relative to a driving axis is configured such that the sliding surface thereof comes into contact with the shoe of the piston and thus the piston is moved in a reciprocal fashion in the bore of a cylinder upon rotation of the swash plate. Accordingly, the lubricating properties of the sliding surface of the swash plate that comes into contact with the shoe are an important design factor in addition to mechanical properties such as wear resistance.

The material for such a swash plate includes hyper-eutectic aluminum alloy, copper alloy, and cast iron.

Specifically, the hyper-eutectic aluminum-silicon alloy used for fixed air conditioning compressors is produced by grinding silicon particles using the fast cooling rate of a continuous casting process and then performing forging. As such, in order to increase lubrication properties of the surface, a self-lubricative tin (Sn) coating process is applied (for reference, the self-lubricative coating refers to a coating process using a material that decreases friction resistance even without the application of a friction material).

However, because it is difficult for the hyper-eutectic aluminum-silicon alloy to control the size of silicon particles and is thus subjected not to typical gravity casting or sand casting but to continuous casting and forging, it is undesirably expensive compared to general aluminum products. Furthermore, seizure stress thereof is less than half of that of copper alloy or cast iron, thus making its application to variable air conditioning compressors having high surface pressure and severe driving conditions difficult.

In addition, the material of the swash plate used for variable air conditioning compressors includes copper alloy and cast iron. These two materials have superior mechanical properties and wear resistance and seizure stress, and are thus currently applied to almost all variable air conditioning compressors. However, the copper alloy is disadvantageous in terms of being more expensive than conventional cast iron or aluminum materials. In the case of cast iron, the sliding surface and the shoe in contact with each other are made of the same material and invoke seizure problems of the same kind under driving conditions, and hence, a specific coating that forms the interface between them is essential.

Taking into consideration the above, there is an urgent need to develop a swash plate made of a novel Al alloy which has higher process freedom and a lower price than the conventional hyper-eutectic aluminum-silicon alloy but has wear resistance and seizure stress equal to or superior to the copper alloy or cast iron material.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention have been made keeping in mind the above problems encountered in the related art, and provide for a swash plate which is made of a novel aluminum alloy which has higher process freedom and a lower price compared to conventional hydro-eutectic aluminum-silicon alloy but wear resistance and seizure stress equal to or superior to copper alloy or cast iron material, and a method of manufacturing the same.

An aspect of the present invention provides a swash plate, comprising aluminum (Al) as a main component and 35~45 wt % of zinc (Zn), 10.5~3.5 wt % of copper (Cu), 6~10 wt % of silicon (Si), 0.2~0.5 wt % of magnesium (Mg) and other inevitable impurities.

In this aspect, the swash plate may further comprise 0.1~0.3 wt % of manganese (Mn).

In this aspect, iron (Fe) and manganese (Mn) may be contained at a ratio of 3:1.

Another aspect of the present invention provides a method of manufacturing a swash plate, comprising melting an alloy composed mainly of aluminum (Al) and additionally of 35~45 wt % of zinc (Zn), 1.5~3.5 wt % of copper (Cu), 6~10 wt % of silicon (Si) and 0.2~0.5 wt % of magnesium (Mg) and then performing mold casting.

In various aspects, casting may be gravity casting or high-pressure casting.

A further aspect of the present invention provides a method of manufacturing a swash plate, comprising melting an alloy composed mainly of aluminum (Al) and additionally of 35~45 wt % of zinc (Zn), 1.5~3.5 wt % of copper (Cu), 6~10 wt % of silicon (Si) and 0.2~0.5 wt % of magnesium (Mg) and then performing sand casting.

In various aspects, casting may be gravity casting.

Still a further aspect of the present invention provides a method of manufacturing a swash plate, comprising continuously casting an alloy composed mainly of aluminum (Al) and additionally of 35~45 wt % of zinc (Zn), 1.5~3.5 wt % of copper (Cu), 6~10 wt % of silicon (Si), and 0.2~0.5% of magnesium (Mg) in the form of a billet and then performing hot forging.

The sliding surface of the swash plate which comes into contact with the shoe of a piston may be subjected to lubricative coating using nickel-fluorine electroless plating or copper or brass electroplating, and the sliding surface of the swash plate coming into contact with the shoe of the piston may be subjected to lubricative coating using nanoresin coating or Teflon coating.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
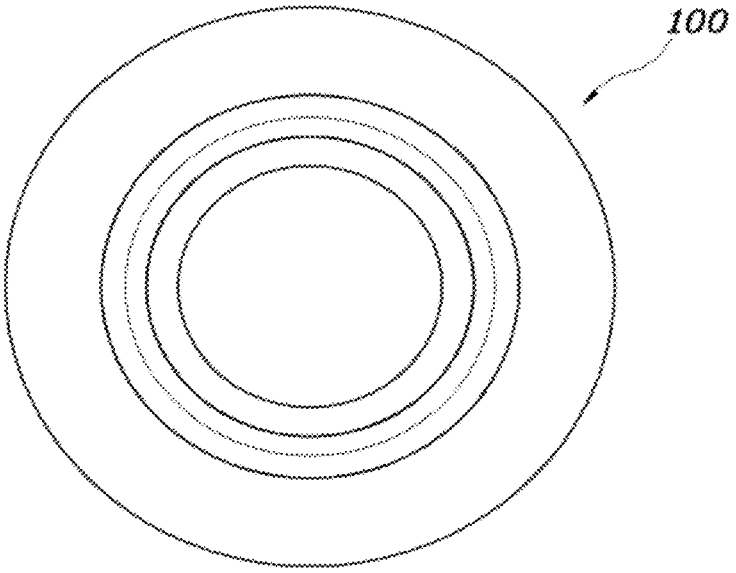
FIG. 1 shows an exemplary swash plate according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims principles of the present invention.

According to various embodiments of the present invention, the swash plate comprises Al as a main component and 35~45 wt % of Zn, 1.5~3.5 wt % of Cu, 6~10 wt % of Si, 0.2~0.5 wt % of Mg and other inevitable impurities. The Si content of this Al alloy is different from that of conventional hyper-eutectic Al alloys, and specifically, Si is used in the remarkably lower amount of 6~10 wt % in the present invention compared to the hyper-eutectic alloy in which Si must exceed 12.6 wt %.

Further, the swash plate may include 0.1~0.3 wt % of Mn so that the ratio of Fe and Mn is 3:1. Various tests proved that the alloy composition of the swash plate according to the present invention was optimal. When the swash plate has such an appropriate composition, all of the wear resistance, processability and lubricating properties which are required of swash plates can be ensured, as will be described later. Furthermore, such a swash plate made of the novel Al alloy has drastically improved performance compared to conventional swash plates.

Specifically, the Si contained in the swash plate according to the present invention is added to induce the formation of fine primary Si particles having a size of 20~30 μm in order to increase wear resistance of the base metal. If the amount of Si is less than 6 wt %, primary Si particles are not produced. In contrast, if the amount of Si exceeds 10 wt %, primary Si particles become coarse, undesirably decreasing processability and wear resistance. When coarse Si particles are formed, hard particles may agglomerate, and wear resistance may instead deteriorate. Thus, the amount of Si in Al is preferably set to 6~10 wt %.

In addition, Zn, which is the next most mainly added after Al, is used to form low-melting-point self-lubricative particles through phase separation with Al. When the low-melting-point self-lubricative particles are formed, the particles themselves function as a lubricating agent even at relatively low temperature, thus decreasing the resistance coefficient. If the amount of Zn added to form the low-melting-point self-lubricative particles is less than 35 wt %, self-lubricative properties may deteriorate. In contrast, if the amount of Zn exceeds 45 wt %, the specific gravity of the base metal may increase and mechanical properties may deteriorate. Hence, the amount of Zn is preferably set to 35~45 wt %.

In addition, Mg is added to produce a precipitation strengthening phase ($MgZn_2$) through the reaction with Zn, and the precipitation strengthening phase is formed by reacting Mg and Zn, thereby enhancing the strength of the swash plate. If the amount of Mg is less than 0.2 wt %, strengthening effects become insignificant. When the amount of Mg is 0.5 wt %, the maximum strength can be obtained. Thus, the amount of Mg is preferably set to 0.2~0.5 wt %.

As an additional element, Mn is added to prevent the production of acicular intermetallic compounds due to the Fe present as an impurity in the base metal. Specifically, the Fe contained as an impurity in Al forms an acicular compound after reacting with Al or Si. When Mn is further added in this way, the acicular shape of such a compound becomes dull. Thus, the amount of Mn is preferably set to 0.1~0.3 wt % to prevent the production of the acicular intermetallic compound in order to increase the strength and elongation of the swash plate. Also, Mn may be added in an amount of ⅓ of the amount of Fe which is an impurity, so that Mn functions as above. Because Al typically contains 0.6 wt % of Fe impurity, the addition of Mn in an amount of 2.0 wt % is proved to be optimal.

Figure 2:
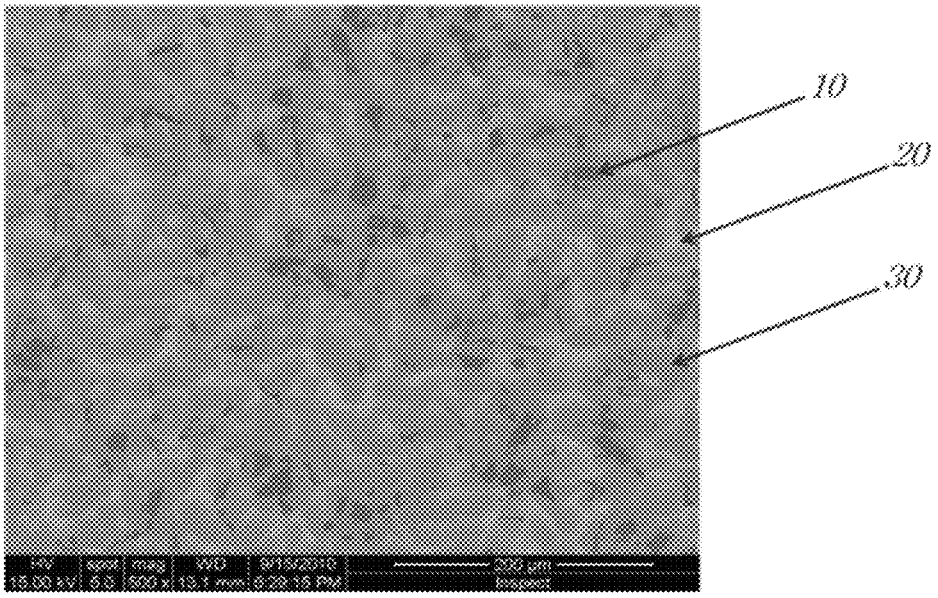
FIG. 2 shows a fine structure of the swash plate of FIG. 1.

FIG. 1 shows the swash plate 100 according to the present invention, and FIG. 2 shows an electron microscope image of the fine structure of the swash plate. As shown in FIG. 2, the swash plate according to the present invention has a composite fine structure comprising hard particles composed of primary Si 10 and soft particles composed of Zn 20 and Al 30, thus exhibiting superior wear resistance and lubricating properties to the extent that this alloy may substitute for conventional Cu alloy.

Also, unlike the conventional alloy, the alloy according to the present invention has a low liquidus temperature of about 500~540° C., and thus there are almost none of the problems of the fine structure being increased in proportion to the cooling rate reduction. The swash plate according to the present invention may have superior properties even when mold casting (gravity, die casting) or sand casting is applied. Briefly, this plate is much less affected by the kind of process.

Specifically, the method of manufacturing the swash plate according to the present invention comprises melting an alloy composed mainly of Al and additionally of 35~45 wt % of Zn, 1.5~3.5 wt % of Cu, 6~10 wt % of Si and 0.2~0.5 wt % of Mg, and then performing mold casting, in which the casting may be either gravity casting or high-pressure casting.

In addition, the method of manufacturing the swash plate according to the present invention may comprise melting an alloy composed mainly of Al and additionally of 35~45 wt % of Zn, 1.5~3.5 wt % of Cu, 6~10 wt % of Si and 0.2~0.5 wt % of Mg and then performing sand casting. In this case, the casting process is gravity casting.

In addition, the method of manufacturing the swash plate according to the present invention may comprise continuously casting an alloy composed mainly of Al and additionally of 35~45 wt % of Zn, 1.5~3.5 wt % of Cu, 6~10 wt % of Si and 0.2~0.5 wt % of Mg in the form of a billet and then performing hot forging.

Further, the sliding surface of the swash plate coming into contact with the shoe of the piston may be coated with metal or non-metal. The metal coating may be a lubricative coating using Ni—F electro less plating or Cu or brass electroplating, and the non-metal coating may be a lubricative coating resulting from coating the sliding surface coming into contact with the shoe of the piston with nanoresin or a fluoropolymer such as polytetrafluoroethylene (PTFE) (e.g., TEFLON).

The following examples may provide a better understanding of the present invention, which are set forth to illustrate, but are not to be construed as limiting the present invention.

Example and Comparative Example

In order to manufacture the swash plate, the swash plate material according to the present invention and an A390 continuous cast alloy were used in the example and comparative example, respectively. The component ratios are shown in Table 1 below.

TABLE 1

| | Zn | Si | Cu | Mg | Fe | Mn |
|---|---|---|---|---|---|---|
| C. Ex. (A390) | — | 18.2 | 3.4 | 0.3 | 0.06 | — |
| Ex. | 40.5 | 7.8 | 1.9 | 0.4 | 0.6 | 0.2 |

The alloy of the example, composed mainly of Al and additionally of 40.5 wt % of Zn, 7.8 wt % of Si, 1.9 wt % of Cu, 0.4 wt % of Mg, 0.6 wt % of Fe and 0.2 wt % of Mn, was melted, after which the melted alloy was subjected to gravity casting using a mold and then processed, and then the surface thereof was electro less plated with Ni—F.

On the other hand, the alloy (A390 continuous cast alloy) of the comparative example was composed mainly of Al and additionally of 18.2 wt % of Si, 3.4 wt % of Cu, 0.3 wt % of Mg, and 0.06 wt % of Fe. This alloy was subjected to continuous casting, T6 heat treatment, forging and then processing, after which the surface thereof was plated with Sn, thus manufacturing a swash plate sample.

Test Example

The strength of the alloy of each of the example and comparative example was measured at room temperature using a tensile tester, and wear resistance thereof was measured using a reciprocal motion wear tester. Also, in order to check whether the alloy may be actually applied to products, the durability of a product simulating the driving conditions of a variable compressor was evaluated. The results are shown in Table 2 below.

TABLE 2

| | Tensile Strength (Mpa) | Elongation (%) | Wear Resistance (Friction Coefficient) | Durability Results |
|---|---|---|---|---|
| C. Ex. (A390 Alloy) | 370 | 1.1 | 0.05 | Fail |
| Ex. | 390 | 1.5 | 0.04 | Pass |

As is apparent from Table 2, the strength of the new alloy according to the present invention at room temperature was increased by 5% because of changes in fine structure, and wear resistance (friction coefficient) was reduced by 20%. According to the durability evaluation results, the Al swash plate of the present invention could be applied to variable air conditioning compressors, replacing conventional Cu alloy and cast iron.

When the swash plate according to the present invention is applied to variable compressors in this way, the cost of thirteen billion five hundred million won per year can be reduced compared to when using conventional Cu alloy, and the weight can also be reduced by 66% (100 g/each). Furthermore, friction properties can be improved by 20% or more compared to conventional hyper-eutectic Al.

As described hereinbefore, the present invention provides a swash plate and a method of manufacturing the same. According to the present invention, Al is added with excess Zn, Si and so on, thus forming a composite fine structure comprising hard particles (primary Si) and soft particles (Zn), thereby ensuring wear resistance equal to that of hyper-eutectic Al—Si alloy, Cu alloy or cast iron.

Also because the fine structure of the alloy is produced due to phase separation at about 500° C., it is not affected by a casting process or a cooling rate unlike hyper-eutectic Al alloy which needs rapid cooling or phosphorus (P) treatment. Thus, even when typical mold casting or sand casting having a low cooling rate is applied, wear resistance can be ensured.

Also, because the fine structure comprising hard-soft particles is provided, in addition to wear resistance, superior lubricating properties can be attained compared to conventional wear resistant materials.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A swash plate having primary silicon particles, the swash plate comprising aluminum (Al) as a main component and 35~45 wt % of zinc (Zn), 1.5~3.5 wt % of copper (Cu), 6~10 wt % of silicon (Si), 0.2~0.5 wt % of magnesium (Mg) and other inevitable impurities, and wherein the primary silicon particles have a size of 20~30 μm.

2. The swash plate of claim 1, further comprising 0.1~0.3 wt % of manganese (Mn).

3. The swash plate of claim 2, wherein iron (Fe) and manganese (Mn) are contained at a ratio of 3:1.

4. A swash plate having primary silicon particles, the swash plate comprising:

aluminum (Al) as a main component;

35~45 wt % of zinc (Zn);

1.5~3.5 wt % of copper (Cu);

6~10 wt % of silicon (Si);

0.2~0.5 wt % of magnesium (Mg); and 0.1~0.3 wt % of manganese (Mn), wherein iron (Fe) and manganese (Mn) are contained at a ratio of 3:1; and wherein the primary silicon particles have a size of 20~30 μm.

5. A method of manufacturing a swash plate according to claim 1, comprising melting an alloy composed mainly of aluminum (Al) and additionally of 35~45 wt % of zinc (Zn), 1.5~3.5 wt % of copper (Cu), 6~10 wt % of silicon (Si) and 0.2~0.5 wt % of magnesium (Mg) and then performing casting.

6. The method of claim 5, wherein a sliding surface of the swash plate which comes into contact with a shoe of a piston is subjected to lubricative coating using nickel-fluorine electroless plating or copper or brass electroplating.

7. The method of claim 5, wherein a sliding surface of the swash plate which comes into contact with a shoe of a piston is subjected to lubricative coating using nanoresin coating or fluoropolymer coating.

8. The method of claim 5, wherein the casting is gravity casting or high-pressure casting.

9. The method of claim 5, wherein the casting is sand casting.

10. The method of claim 9, wherein a sliding surface of the swash plate which comes into contact with a shoe of a piston is subjected to lubricative coating using nickel-fluorine electroless plating or copper or brass electroplating.

11. The method of claim 9, wherein a sliding surface of the swash plate which comes into contact with a shoe of a piston is subjected to lubricative coating using nanoresin coating or Teflon coating.

12. The method of claim 9, wherein the casting is gravity casting.

13. A method of manufacturing a swash plate according to claim 1, comprising continuously casting an alloy composed mainly of aluminum (Al) and additionally of 35~45 wt % of zinc (Zn), 1.5~3.5 wt % of copper (Cu), 6~10 wt % of silicon (Si), and 0.2~0.5 wt % of magnesium (Mg) in a form of a billet and then performing hot forging.

14. The method of claim 13, wherein a sliding surface of the swash plate which comes into contact with a shoe of a piston is subjected to lubricative coating using nickel-fluorine electroless plating or copper or brass electroplating.

15. The method of claim 13, wherein a sliding surface of the swash plate which comes into contact with a shoe of a piston is subjected to lubricative coating using nanoresin coating or fluoropolymer coating.

16. The method of claim 5, wherein the casting is mold casting.

* * * * *